US006266942B1

(12) United States Patent
McClorey

(10) Patent No.: US 6,266,942 B1
(45) Date of Patent: Jul. 31, 2001

(54) PACKAGING KIT FOR WRAPPING PAPER

(76) Inventor: John McClorey, 9220 Karlov, Oak Lawn, IL (US) 60453

( * ) Notice: Subject to any disclaimer, the term of this patent is extended or adjusted under 35 U.S.C. 154(b) by 0 days.

(21) Appl. No.: 09/178,796

(22) Filed: Oct. 26, 1998

(51) Int. Cl.[7] ..... B65B 67/00
(52) U.S. Cl. ..... 53/390; 206/225; 206/391
(58) Field of Search ..... 53/389.1, 389.2, 53/389.3, 389.4, 390, 202; 206/225, 391; 225/106

(56) References Cited

U.S. PATENT DOCUMENTS 3,176,443 * 4/1965 Klamp ..... 53/390
3,367,589 * 2/1968 Chant, Jr. et al. ..... 53/389.3
3,702,672 * 11/1972 Becht ..... 225/106
4,204,618 * 5/1980 Reed et al. ..... 225/106
4,341,586 * 7/1982 Koutonen ..... 53/389.4
4,566,606 * 1/1986 Kling ..... 206/225
4,667,456 * 5/1987 Raffault ..... 53/390
4,989,734 * 2/1991 Mode et al. ..... 206/225
5,035,321 * 7/1991 Denton ..... 206/225
5,655,356 * 8/1997 Ginestra ..... 53/389.3
5,806,278 * 9/1998 Shelledy ..... 53/390
5,893,822 * 4/1999 Deni et al. ..... 53/389.3

* cited by examiner

*Primary Examiner*—Eugene L. Kim

(57) ABSTRACT

A chest including a box for holding a plurality of rolls of paper. It includes a tray at the front for holding extra items, slidable between an inner position and an outer position. A roller and pressure shoe are operable for advancing linear lengths of paper from the rolls through a slit formed at the front of the box. The chest includes a hinged lid, on the swinging edge is a cut-off knife. Troughs are provided for holding the rolls of paper.

9 Claims, 2 Drawing Sheets

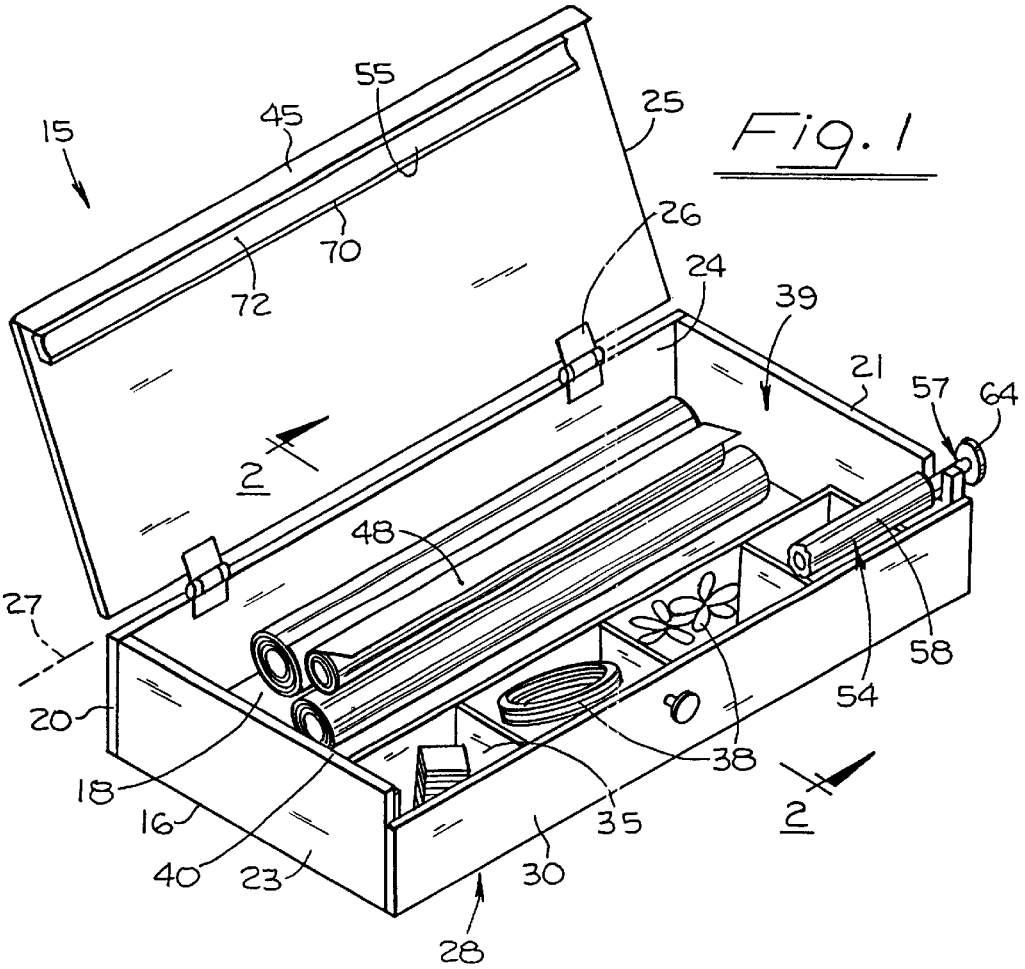
Fig. 1
Fig. 2
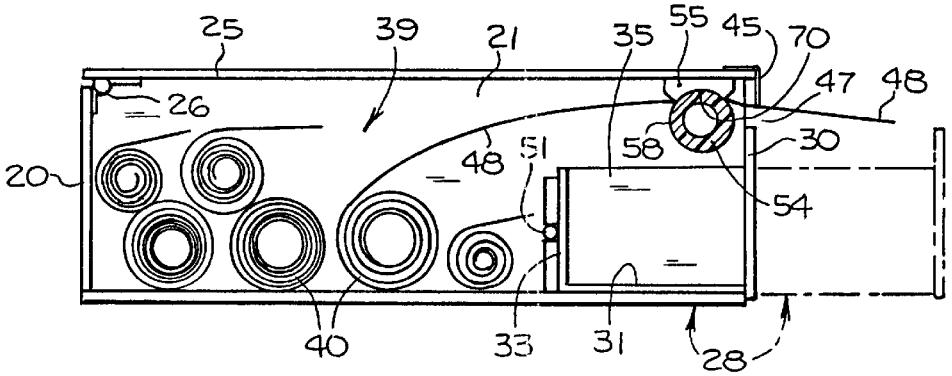

PACKAGING KIT FOR WRAPPING PAPER

FIELD OF THE INVENTION

The invention is in the field of handling wrapping paper, and for storing it while it is not being used for wrapping.

Heretofore it has been a problem for storing wrapping paper when it is not in use, and to make it readily accessible when it is desired to use it. A most conspicuous example of the problem is in the case of the Christmas season, because the distinctive Christmas wrapping paper is not used between Christmas seasons, or for nearly a full year.

SUMMARY OF THE INVENTION

The device of the present invention includes a chest which will accommodate a substantial supply of wrapping paper, and associated elements.

A main object of the invention is to provide a chest of the foregoing character which has the following features and advantages.

1. It will accommodate a relatively large number of rolls of wrapping paper, of different colors or patterns, that can be easily withdrawn individually and selectively, without interference with or from the other rolls.

2. The chest includes a manually actuated roller to initiate removal of a sheet of the wrapping paper.

3. The chest has accommodation for associated items, such as ribbons, twine, etc. that are also easily accessible in the operation of withdrawing paper, and wrapping an article.

4. It is a self-contained kit, and easily portable.

5. It is of such dimensions and proportions as to be set in a convenience place when it is in use, and put in a convenient storage space when it is not in use, such as under the bed, so as to utilize space that may not otherwise be used.

BRIEF DESCRIPTION OF THE INDIVIDUAL FIGURES OF THE DRAWINGS

FIG. 1 is a perspective view of the chest of the invention, with the lid in open position.

FIG. 2. is a cross-sectional view taken at line 2—2 of FIG. 1 and showing the lid in closed position.

DETAILED DESCRIPTION OF THE DRAWING

Figure 3:
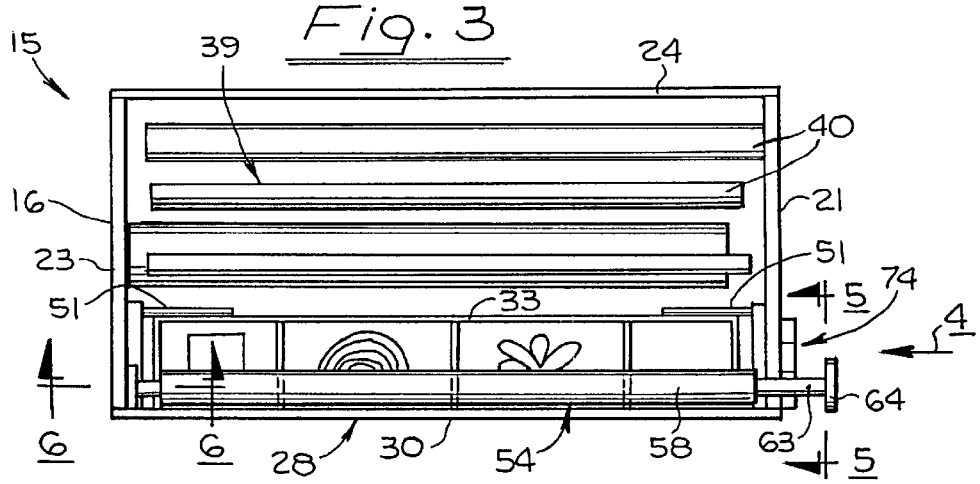
FIG. 3 is top view with the lid in open position.

The chest of the invention is shown at 15, and includes a box 16 having a bottom member 18 also referred to as a bottom, wall means 20 which includes a right side wall 21, a left side wall 23 and a back wall 24. It includes a front wall referred to hereinbelow.

The chest includes a lid or cover 25 mounted on the rear wall by hinge means 26 disposed on a axis 27.

Figure 7:
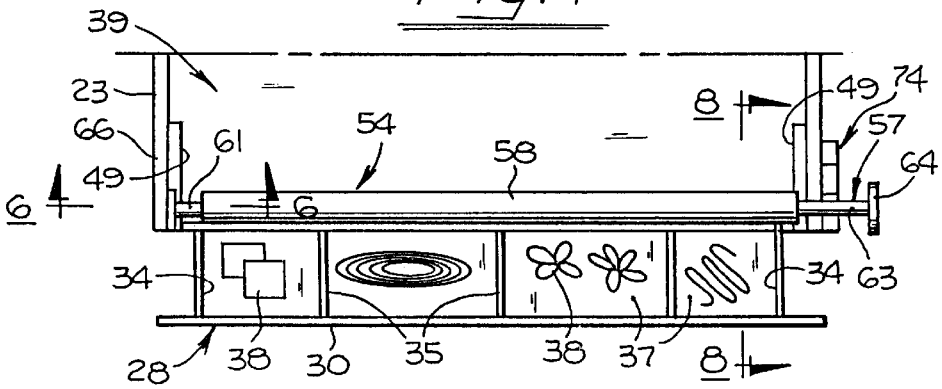
FIG. 7 is a top view of the front portion of the chest with the cover in open position.

Mounted in the front part of the chest is a tray 28 which includes a front panel 30 a bottom element 31 (FIG. 2), also referred to as a bottom, and a back panel 33. It also includes transverse pieces which include end closure elements 34 (FIG. 7) and partitions 35, forming cells or pockets 37 for receiving and holding related items such as tape, ribbons, bows, etc. indicated at 38. The tray extends across the box, and is slidable on the bottom 18 of the box to an inner position (FIG. 1) in which it is contained substantially within the box, and to an outer position (FIGS. 2, 7) in which it is displaced from confinement in the box, and accessible to the user for grasping the items 38 therein.

The tray preferably occupies a small portion of the interior of the box, at the front thereof, and rearwardly of the tray is a space 39 forming a storage area for receiving the rolls of paper 40. The chest is dimensioned for receiving the rolls in position parallel with the hinge axis 27 and the paper is withdrawn linearly from the rolls as referred to below.

The space 39 is of great size, capable of holding in the neighborhood of 15 standard rolls of paper. The rolls are simply placed in a pile.

FIG. 2 shows the lid in closed position terminating forwardly adjacent the forward edge of the side walls 21, 23. Mounted on the front or swinging edge of the lid is a knife or cutting bar 45, extending across the front edge of the lid. This knife may conveniently be in the form of an angle having a top flange secured flat against the top edge of the lid, and a cutter edge 46 positioned forwardly of the edge of the lid and extending downwardly a short distance below the lid.

The front panel 30 of the tray forms the front wall of the box, but this front panel is of lesser vertical extent than the side walls 21, 23, leaving a gap 47 (FIG. 2) for withdrawal of the linear lengths of the paper from the chest. A leading edge of one of the rolls is shown at 48. This gap 47 may also be referred to as a slit, particularly in the claims.

Figure 8:
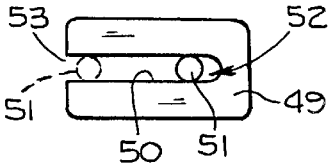
FIG. 8 is a view taken at line 8—8 of FIG. 7.

Means is provided for slideably mounting the tray 28 in the chest, which includes plates or cleats 49 (FIGS. 7, 8) secured to the end walls 21, 23, respectively, and each having a horizontal groove 50 therein. Mounted on the inner side of the tray 28, and extending longitudinally beyond the ends thereof, are pins 51 (FIGS. 3, 8) which slide in the grooves 50. The grooves are closed at their outer ends (FIG. 8) as indicated at 52 and open at their inner ends as indicated at 53. When the tray is pulled to its outer position (FIG. 2) the pins engage the front closed ends of the grooves, and the tray is limited to its normal outer position and prevented from being withdrawn from the box.

Means is provided for gripping the leading end of the paper and advancing it through the slit 47. This means includes (FIGS. 1, 2, 7) a roller 54, and a pressure shoe 55, the roller 54 including a central continuous shaft 57 and a sleeve 58 thereon. The central shaft 57 is rigid, while the sleeve 58 is of rubber, or other material having similar resilience. The shaft 57 extends beyond the ends of the sleeve, having an inner end 61 (FIG. 7) and an outer end 63 and on the outer end is secured a manually actuatable knob 64.

Figure 5:
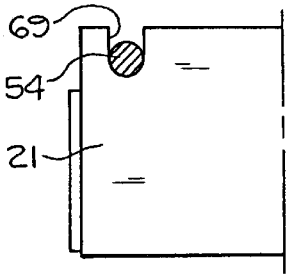
FIG. 5 is a view taken at line 5—5 of FIG. 3.
Figure 6:
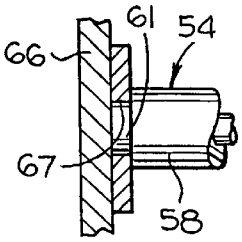
FIG. 6 is a view taken at line 6—6 of FIG. 3.

The roller is detachably mounted in the box, the left side wall 23 having a plate 66 (FIGS. 6, 7) with a hole 67 therein receiving the inner end 61 of the shaft of the roller. At the other end, i.e., in the right side wall 21 (FIG. 5) is an upwardly opening notch 69 in which the roller shaft 54 is fitted. The shaft is put in place by first fitting the end 61 of the shaft in the hole 67 and lowering the other end so that the shaft fits in the notch 69.

The pressure shoe 55 (FIGS. 1–2) is in the form of a plate mounted on the under surface of the lid, adjacent the swinging edge thereof, but spaced inwardly therefrom a short distance. This plate has an undersurface 70 with a longitudinal groove 72 therein. The pressure plate and the roller are so relatively positioned that when the lid is in closed position, the pressure shoe engages the roller, the roller entering into the groove, and the resilient sleeve on the roller yielding under this pressure.

In the use of the device, the user (FIG. 2) grasps a leading edge 48 of a linear length of the paper of one of the rolls and, with the lid at least partially open, pulls it forwardly out of the box and then lowers the lid. The paper is gripped between the roller and pressure shoe and firmly held in position thereby. The roller is then turned by grasping the knob 64 (FIGS. 3, 7) and so turned to advance the paper outwardly beyond the front of the chest a short distance. The roller can then be turned further for extending the linear piece the full length desired, or the user may grasp the edge of the paper and pull it. When it has been withdrawn the desired amount, the user tears the sheet against the knife 45 and cuts off a leading piece. In this phase of the use of the device, the tray 28 would desirably be pulled to its outer position (FIGS. 2, 7) to make the contents 38 thereof accessible for completing a wrapping step.

Figure 4:
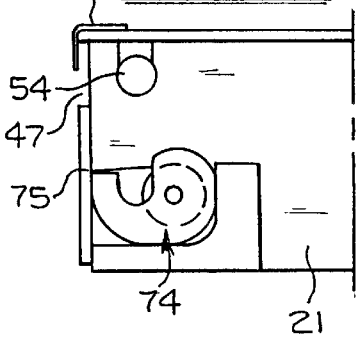
FIG. 4 is a fragmentary end view according to the arrow 4 of FIG. 3.

Mounted on the outer surface of the right side wall 21 (FIGS. 3, 4) is a supply of adhesive tape 74 having an outlet 75, through which tape may be withdrawn. This location of the tape is positioned adjacent the knob 64, of the roller, for convenience in reaching it by the same hand that manipulates the knob.

The chest may be made of desired material, such as cardboard, wood, plastic, etc., except the sleeve of the roller, and the knife 45 which may be made of metal.

I claim:

1. A chest for storage and using of wrapping paper, comprising, a box having a front, a rear, and sides, the box including a bottom and a wall, the wall including an element at the rear and each side respectively, the box also including a lid hinged at a rear thereof to the rear wall element and swingable on an axis extending side-to-side of the box, between open and closed position, the chest including a tray at the front side extending to a height lower than said wall elements, the tray having pockets for holding wrapping materials and being slidable in front-to-rear direction between an inner position in which the pockets are substantially within the interior of the box and an outer position exposing the wrapping materials to the exterior, the box when the lid is open, and except for the tray, having an open top and being empty, the box inwardly of the tray forming a space for receiving a plurality of rolls of paper in position parallel with said axis, loose and detached from the box, and confined only by the perimeter members defining the box, the upper edge of the tray forming a slit with the swinging edge of the lid when the lid is in closed position, the paper of the rolls being capable of being withdrawn linearly therefrom across the box adjacent the top thereof through the slit, and a knife edge on the swinging edge of the lid and extending downwardly when the lid is closed, and forming a cutting edge for cutting paper withdrawn from the slit in response to pulling the paper against the knife edge.

2. A chest according to claim 1 wherein, said space is of sufficient depth to enable the paper withdrawn from near the rear to pass over rolls of paper forwardly thereof when the lid is closed.

3. A chest according to claim 1 and including, gripping means extending uniformally entirely across the front of the chest operable for gripping a leading edge of a paper and advancing it outwardly through the slit in response to manual operation of the gripping means.

4. A chest according to claim 3 wherein, the gripping means includes a manually actuatable roller and a concave shoe normally engageable with the roller, and so engageable with a paper between the roller and shoe.

5. A chest according to claim 4 wherein, the roller is removably mounted in a box and supported entirely by the side wall elements of the box, and the concave shoe is secured to the lid.

6. A chest according to claim 1 wherein, the tray includes an inner portion having elements forming the pockets, and a vertical front panel, the tray is so dimensioned and proportioned that when the tray is in its inner position, said portion is below the gripping means, and the front panel forms the lower limit of said slit and it forms a front wall element which with said rear and side wall elements forming a wall entirely surrounding the bottom.

7. A chest according to claim 6 and including, guide means for guiding the tray in its movement between inner and outer positions including cleats on the adjacent wall elements of the box, the cleats having horizontal grooves therein open at their rear ends and closed at their front ends, and the tray has pins at its rear edge extendible into the grooves, and co-operable with the grooves, for guiding the tray, and preventing the tray from being withdrawn forwardly from the box, and the grooves and pins being so located, and the tray being so proportioned, that the tray rests on the bottom of the box.

8. A chest according to claim 1 wherein, the side wall elements adjacent the front, the lid, and the front panel of the tray are all so relatively dimensioned, positioned and proportioned that when the tray is in its inner position, and the lid is closed, the swinging edge of the lid is substantially in the plane of the front outer surface of the front panel of the tray.

9. A chest for storage and using of wrapping paper, comprising, a box having a surrounding wall, a bottom, and an open top, the box having a lid mounted on a hinge at a rear edge of the wall and swingable between an open position and a closed position, the lid when in closed position forming a slit between its swinging edge and the wall, the box having a space in the interior for receiving rolls of paper in position parallel with the axis of the hinge, the paper of the rolls being capable of being withdrawn inwardly therefrom across the box adjacent the top thereof and through said slit, the box having means at said slit for cutting off a leading portion of paper being withdrawn, the paper of each roll being capable of being withdrawn selectively independently of any of the other rolls, gripping means extending across the front of the chest operable for gripping a leading edge of a paper and advancing it outwardly through the slit in response to manual operation of the gripping means, the gripping means including a manually actuable roller and a concave shoe normally engagable with the roller, and so engagable with a paper between a roller and shoe, the roller being removable mounted in the box, the concave shoe being secured to the lid, the roller having an end extending to the exterior of the box and a knob on the extended end, and a supply of adhesive tape mounted on the exterior of the box adjacent to the front of the box and adaptable to release of the tape in response to actuation by the user of the chest.

* * * * *